United States Patent [19]

Snider

[11] 4,400,679

[45] Aug. 23, 1983

[54] SNAP ACTING SWITCH FOR THERMOSTATS

[75] Inventor: Harold F. Snider, Mansfield, Ohio

[73] Assignee: Therm-O-Disc, Incorporated, Mansfield, Ohio

[21] Appl. No.: 304,016

[22] Filed: Sep. 21, 1981

[51] Int. Cl.[3] ..... H01H 37/46

[52] U.S. Cl. ..... 337/382; 337/390; 337/394

[58] Field of Search ..... 337/131, 139, 382, 383, 337/384, 388, 389, 390, 391, 392, 393, 394

[56] References Cited

U.S. PATENT DOCUMENTS 3,899,765 8/1975 Daigneault, Jr. ..... 337/390 X 4,166,995 9/1979 Pecker et al. ..... 337/390

*Primary Examiner*—George Harris

*Attorney, Agent, or Firm*—Pearne, Gordon, Sessions, McCoy, Granger & Tilberry

[57] ABSTRACT

A snap acting switch structure for thermostats or the like is disclosed in which the switch's movable contact is supported on a pair of arms the first of which is placed in compression and the second of which is placed in tension by a bistable spring system. The first arm is formed of relatively thin metal providing deep flanges to cause the arm to act as a rigid beam pivoted at one end. The two arms are welded together in face-to-face adjacency and the actuating force applied to the switch is applied substantially at the joint between the arms. Therefore, there are no substantial bending forces applied to the first arm, and the switch efficiently produces good wiping between the contacts and sufficient shear forces to break welds which may occur therebetween. The operating temperature differential is established for a given contact gap value by selecting the position of a calibration screw along the length of one leg of the snap spring system so that it cooperates with the stiffness of such leg to control the position of the joint between the snap spring legs to cause proper temperature differential.

16 Claims, 6 Drawing Figures

SNAP ACTING SWITCH FOR THERMOSTATS

BACKGROUND OF THE INVENTION

This invention relates generally to condition-sensing switching devices and, more particularly, to a novel and improved switch for thermostats or the like and to thermostats incorporating such switches.

Prior Art

Thermostatic switching devices similar to the present invention are known. Examples of such devices are illustrated in U.S. Pat. Nos. 3,170,998 and 4,166,995, and such patents are incorporated by reference in their entirety to establish prior art and to set forth the manner in which such switches operate. Such prior art switches are difficult to consistently produce particularly when low temperature differentials are required. Further difficulty is often encountered when such devices must be operable through extremely large numbers of operating cycles without failure due to contact deterioration or welding.

SUMMARY OF THE INVENTION

In accordance with the present invention, a novel and improved switch structure is provided which is capable of being operated, in thermostats or the like, through very large numbers of cycles without contact failure or welding. Further, such improved operation can be obtained in devices which operate with low temperature differentials.

In the illustrated embodiment, a snap action contact support structure is provided which is not subject to any significant bending moments so that the contact support arms operate as substantially rigid members. Therefore, there is little or no springiness in the support system, and shear forces are efficiently produced to break any welds which may occur between the contacts.

Further, the stiff switch structure permits the consistent production of thermostats or the like with small operating differentials even when the operating forces are relatively small. In the illustrated embodiment, a first switch arm is subjected almost entirely to compression forces without any significant bending forces and a second switch arm is subjected substantially only to tension forces. The first arm is formed of relatively thin material and is provided with relatively deep flanges to give a maximum stiffness. An integral pivot structure is provided at one end of the first arm by cutting the arm material away a sufficient amount so that the thin material of the arm provides a pivotlike bending movement, with relatively small resistance to such movement.

The second arm, because it is subjected almost entirely to tension forces, can be relatively flexible without encountering undesirable bending. However, since the movable contact is mounted on the second arm and provides a contact surface which is offset from the plane of the arm, the arm can, when welds are encountered, bend to some degree to produce a rolling movement between the contacts which combines with the available shear forces to break any welds which exist between the contacts.

Further, the geometry is arranged to permit the selection of substantially any desired operating temperature differential for a given contact gap. Since the support arms do not bend to any material degree, the differential temperature of the device is determined almost entirely by the precision with which the joint between the legs of the bistable spring system is positioned. It is a further aspect of this invention to structure a device so that positioning of such joint is established to produce the desired operating temperature differential. This is accomplished by selecting the location of the calibration screw with respect to the stiffness of the spring system leg which it engages so that the movement of the joint is controlled in a manner that results in the desired temperature differential. For example, when greater temperature differentials are required, the calibration screw is located closer to the body mounting column and when smaller temperature differentials are required, the pivot is located at a point more remote from the body mounting column.

These and other aspects of this invention are illustrated in the drawings, and are more fully described in the following specification.

DETAILED DESCRIPTION OF THE DRAWINGS

Figure 1:
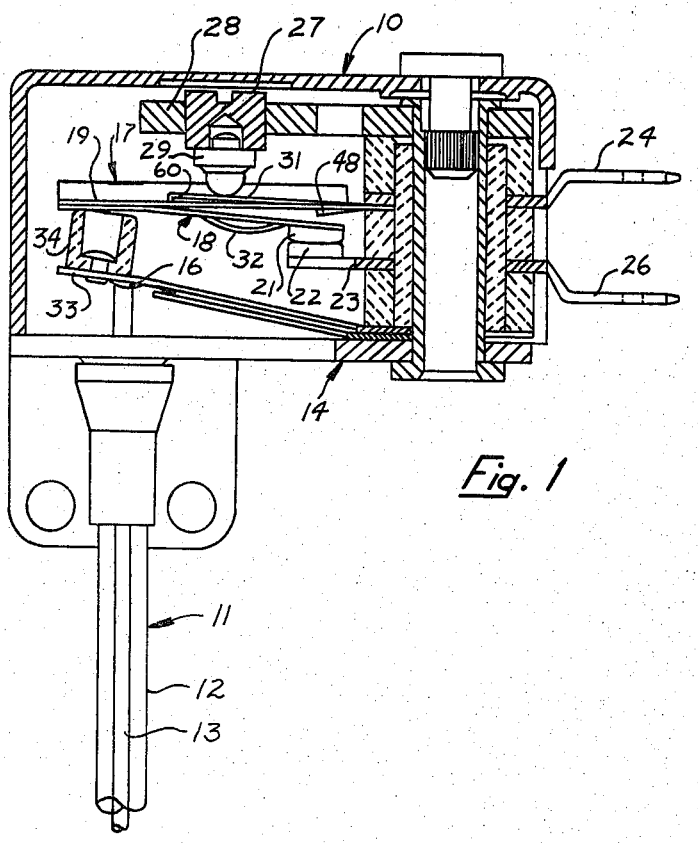
FIG. 1 is a side elevation of a preferred form of this invention, in which the temperature-sensing mechanism is a differential expansion probe assembly.

Referring to FIG. 1, the switch assembly 10 is illustrated in combination with a probe-type thermal actuator 11 to provide a thermostat combination. The actuator 11 includes a glass tube 12 and a metallic rod 13, which have different coefficients of thermal expansion so that relative movement is produced between the switch body 14 and the adjacent end 16 of the rod in response to changes in the temperature of the probe elements. Such relative movement is operable to cause switch operation in a predetermined manner, described below. Reference should be made to U.S. Pat. No. 3,732,518 (assigned to the assignee of the present invention) for a more detailed description of such probe, and such patent is incorporated herein by reference for such additional description.

The switch assembly 10 includes the body assembly 14, which in the illustrated embodiment is a stack-type body assembly. Mounted on the body assembly is a first cantilever arm or carrier 17 and a second arm 18 extending back along the first arm 17. The second arm 18 is welded at 19 to the first arm 17 in face-to-face adjacency substantially adjacent to the free end of the latter. Mounted on the free end of the second arm 18 is a movable contact 21. The movable contact 21 is supported on the arms 17 and 18 for movement into and out of engagement with the fixed contact 22, which is in turn supported on a support arm 23 mounted on the body 14. A first terminal 24 is electrically connected through the arms 17 and 18 to the movable contact and a second terminal 26 is electrically connected to the fixed contact 22. Electrical continuity is provided between the terminals when the contacts are closed as illustrated and the terminals are electrically isolated when the contacts are open.

A calibration screw 27, which is threaded into a support plate 28, is provided with a nonconductive end calibration member 29 which engages one side of a center leg 31 of the first arm 17 to adjustably position such leg 31 for calibration of the thermostat.

A center leg spring portion 32 of the second arm 18 interfits at its end with the center leg 31 of the first arm 17 to produce a bistable spring system which causes the movable contact to move back and forth between the open and closed position with snap action.

The rod end 16 is connected to a cantilever spring member 33, which in turn supports a nonconductive switch operator 34. The switch operator 34 in turn engages the outer end of the two arms 17 and 18 and moves them vertically, as illustrated in FIG. 1, to cause the snap operation of the switch in response to temperature changes of the probe assembly 11.

Figure 2:
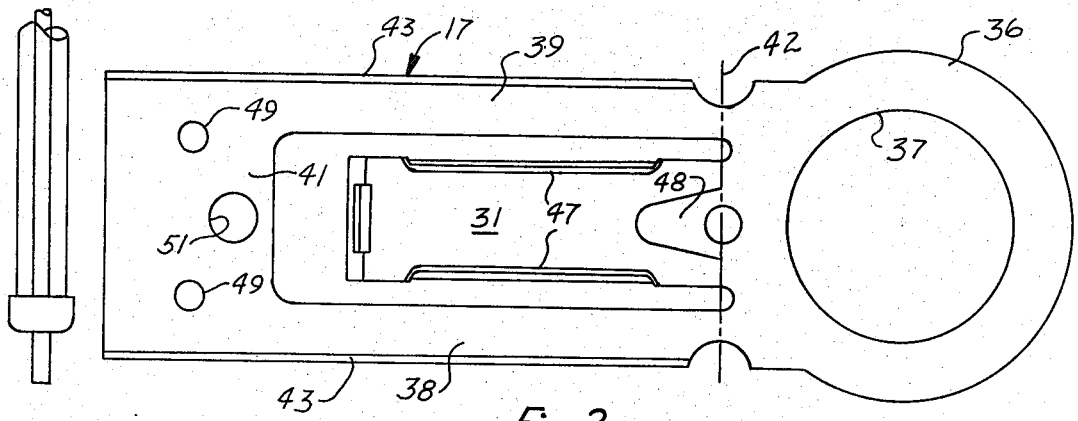
FIG. 2 is a plan view of the first support arm prior to the mounting of the second support arm thereon.

The shape and structure of the first arm or carrier 17 is best illustrated in FIG. 2. This arm is provided with a mounting portion 36 having a central opening 37 permitting the arm to be cantilever-mounted in the stack portion of the body. As best illustrated in FIG. 2, the arm is cut out to provide the central leg 31 and a pair of side legs 38 and 39 which extend with clearance along the opposite sides of the center leg. The side legs 39 are joined at their inner ends by the mounting portion 36 and at their outer ends by a lateral strap portion 41. Between the mounting portion 36 and the side legs 38 and 39 is a pivot section which allows the side legs to pivot along the pivot centerline indicated at 42. The material of the legs along such pivot line is cut away a substantial amount so that the relatively thin metal used to form the carrier arm 18 can bend with pivotlike movement along such line 42 with relatively small resistance to such pivotlike bending movement.

Figure 3:
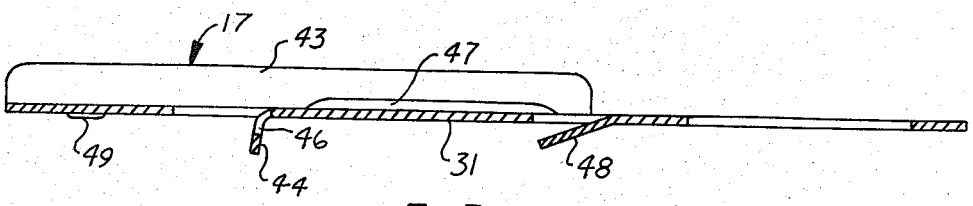
FIG. 3 is a side elevation in longitudinal section of the support arm of FIG. 2.

Beyond the pivot line 42 the arms 38, 39 are provided with relatively deep side flanges 43 which make the arms 38 and 39 substantially rigid. Such flanges also extend out along the lateral strap portion to also stiffen such portion. Consequently, the arm 18 is in effect a rigid member mounted for pivotal movement along a pivot axis at 42. The center leg 31 is also supported for pivotal movement along the same pivot line and is provided with a laterally extending end portion 44 having a lateral opening 46 therein into which the end of the center leg 32 fits in the assembled device. Here again, side flanges 47 are formed on the center legs 31 to increase the stiffness thereof. A stop portion 48 is cut from the center leg material and extends downwardly at an angle as best illustrated in FIG. 3 to provide a stop which limits the travel of the movable contact 21 in a direction away from the fixed contact 22 and determines the maximum spacing therebetween when the switch is opened.

A pair of weld projections 49 are provided in the strap portion 41 which determine the location of the weld connection between the two arms 17 and 18. A locating opening 51 cooperates with a similar opening 52 in the second arm 18 to provide precise positioning of the two arms when they are welded together during assembly of the device.

Figure 5:
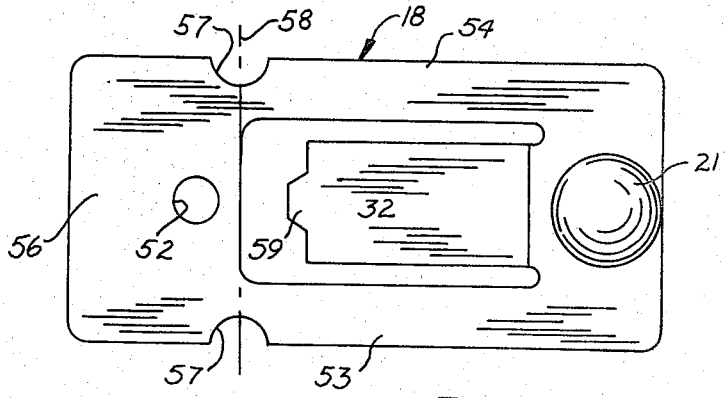
FIG. 5 is a plan view of the second arm.

The structure of the second arm 18 is best illustrated in FIG. 5. Such arm is again formed of relatively thin metal and is cut out to provide the center leg 32 which extends in spaced relation between similar but opposite side legs 53 and 54. In this instance, the side legs 53 and 54 are joined at their ends with a mounting portion 56 which, in the assembled device, is welded to the weld lugs 49. The material of the side legs is cut out at 57 to again provide a reduced section so that the free end of the second arm can bend with pivotlike movement along a bend line 58. The movable contact 21 is mounted on the opposite end substantially adjacent to the end of the center leg 32. The free end of the center leg 32 is formed with a projection 59 proportioned to fit into the opening 46 in the center leg 31 of the first arm 17.

Figure 4:
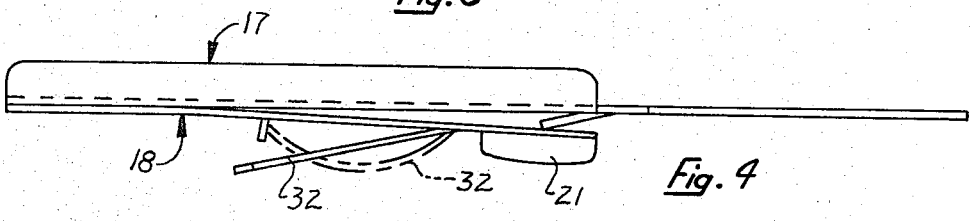
FIG. 4 is a side elevation in longitudinal section of the subassembly consisting of the first support arm and the second support arm prior to the engagement of the spring system which renders the assembly bistable.

The subcombination consisting of the two arms 17 and 18 is illustrated in FIG. 4. In such subcombination, the arm 18 with the movable contact 21 mounted thereon is welded to the underside of the first arm 17 at the weld projections 49. After welding, the ends of the two arms are in face-to-face contact. Also after welding, the center leg 32, which initially is straight and inclined downwardly as illustrated in full line, is bent to the phantom line position and the end projection 59 is placed in the slot 46 in the center leg of the first arm 17. This places the outer legs 38 and 39 of the first arm 17 in compression, and the outer legs 53 and 54 of the second arm in tension, and creates a bistable spring system when the subassembly is installed in the switch body with the probe and the calibration screw.

The calibration screw 27 is then adjusted to properly position the joint at 60 between the two center legs so that when the desired temperature for opening of the contacts is reached, the relative position between the outer end of the two arms as determined by the position of the operator 34 with respect to the joint between the two center legs as determined by the position of the calibration screw, causes the movable contact to move from the closed position illustrated with snap action to its open position against the stop 48. Thereafter, when the probe reaches the second operating temperature (the closing temperature), the switch is reclosed with snap action and the two contacts 21 and 22 are then again in engagement. The movement created by the probe as it reaches the closing temperature causes downward movement, as illustrated in FIG. 1, of the operator and corresponding downward movement of the outer end of the two arms, again causing a condition of instability determined by the relationship between the position of the outer end of the arms and the joint 60 between the two center legs.

Because the first arm 17 is provided with deep flanges, such arm is very rigid even though it is formed of relatively thin material and is able to withstand the compressive forces applied to it without any material bending. This lack of bending is also a result of a structure in which the planes of the two arms intersect at a location substantially adjacent to the point of contact with the operator. If, for example, the joint between the two arms 17 and 18 were offset from the plane of the arm 17 which is in compression, there would be a bending moment applied to the arm 17 which would tend to cause flexure thereof. Such bending moments, however, do not exist in the structure of the present invention to any material degree, and the arm 17 acts as a rigid member and does not flex.

The arm 18, on the other hand, is in tension and there is no material bending moment applied thereto except when it is necessary to break a weld between the contacts. Such bending moment results from the fact that the face of the movable contact 21 where welds occur is offset from the plane of the arm 18 by a distance equal to the thickness of such contact. Flexing in such instance assists in breaking the welds and assists in continued proper operation of the switch because it produces a rolling movement between the contacts which actually assists in breaking any welds which might exist therebetween.

Further with this structure, there is a good wiping action between the contacts since the geometry is such that as the free end of the arm is raised and approaches the opening position, the movable contact 21, while remaining in engagement with the fixed contact 22, moves to the left with respect to the fixed contact as viewed in FIG. 1, producing a wiping action between the contacts. This wiping action greatly facilitates the extended life of the switch and also tends to break welds which may occur between the contacts.

In actual tests, the switch as illustrated was successfully operated through 700,000 cycles when subjected to 240 volts and a current of 12 amps. Such thermostat provided a temperature differential between the opening and closing temperature of about 10°-15° F. Further, this small temperature differential was achieved while providing a relatively large gap in the order of 0.008 inch between the contacts and the switch-open position. With such gap, the thermostat can be safely used to interrupt substantially higher voltages and can be used, for example, in a circuit in which it is controlling a voltage in the order of 380 volts.

The ability to provide such long life was to a great extent the result of providing a structure in which no significant bending occurred in the first arm so that large shear forces were achieved to break any welds which existed between the two contacts.

The ability to produce a large shearing force to break welds, with a relatively small force applied by the thermal actuator, such as the probe assembly 11, is due to the combination in which the compressively loaded arm 17 is not subjected to any substantial bending moments and is sufficiently rigid to prevent any bending, in combination with a structure in which the angle between the two arms is small so as to produce a large force multiplication. In other words, the structure is arranged so that a relatively small force applied to the free end of the two arms is capable of producing a shear force between the contacts which is substantially larger in magnitude without causing any appreciable bending in a compressibly loaded arm.

In accordance with this invention, it is also possible to achieve relatively large gaps with relatively low temperature differentials and to structure a given switch to provide an operating differential of almost any size with a relatively large gap between the contacts in the contact-open position. If, for example, a narrower temperature differential is required for a given contact gap value, the switch is constructed so as to maintain the position 60 of the connection between the two center legs in a more precise manner. This is accomplished by either moving the calibration screw out to a location closer to the joint between the two center legs at 60 so as to maintain such joint position more precisely or by increasing the stiffness of the center leg 31 by increasing the depth of the flanges 47. On the other hand, if a larger differential is required for a given gap, the switch is constructed with the calibration screw at a location spaced further from the joint at 60 between the two center arms or by constructing the center arm 31 with lower flanges or no flanges so that it is more flexible. Therefore, it is possible with the present invention to construct a switch having a relatively large gap between the contacts in the contact-open position and to match the switch to virtually any type of thermal actuator or any differential temperature required. Normally, however, it is preferred to locate the calibration screw closer to the joint between the leg than to the opposite end of the leg 31.

In the embodiment of FIG. 1, in which the thermal actuator is a differential expansion probe assembly, relatively large forces can be obtained for a given amount of temperature change, but the distance through which the probe causes movement of the outer end of the two arms is relatively small for a given temperature change. The illustrated switch assembly, however, is highly suitable for such type of thermostat, since the location of the calibration screw along the length of the center arm 31, in combination with the stiffness of such arm selected, permits relatively large gaps to be provided by relatively small movement of the outer end. In such a device, long service life can be obtained because of the good wiping action between the contacts and the ability of the device to provide sufficient shear forces to readily break any welds which may occur between the contacts.

The present invention is also highly desirable in thermostat or condition sensing devices which do not create as great a force for a given change in temperature.

Figure 6:
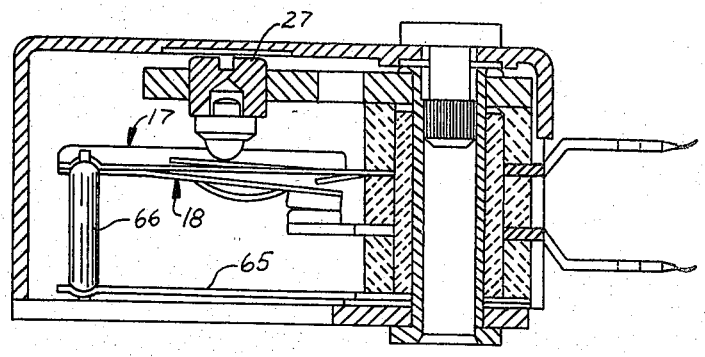
FIG. 6 is a side elevation of a thermostat incorporating a bimetal blade temperature-sensing element.

For example, FIG. 6 illustrates an embodiment in which the switch is actuated by a bimetal leaf spring. In such a device, the switch structure is virtually identical, but the thermal actuation of the switch is provided by a cantilever-mounted bimetal leaf spring 65. A push rod 66 type operator is positioned between the free end of the bimetal actuator and the outer end of the arms 17 and 18 in such a device, where relatively low thermally induced forces are available for a given temperature change. The structure of the switch, however, lends itself to proper operation over a large number of cycles because of the ability to produce large shear forces to break any welds which might exist between the contacts in response to relatively small actuating forces applied to the outer ends of the switch assembly. Further, it is possible again with this embodiment to establish substantially any desired operating temperature differential for a given contact spacing in the open condition by appropriately locating the calibration screw and providing the proper rigidity for the central leg 31.

Although the preferred embodiment of this invention has been shown and described, it should be understood that various modifications and rearrangements of the parts may be resorted to without departing from the scope of the invention as disclosed and claimed herein.

What is claimed is:

1. A condition-sensing switching device comprising a body, a fixed contact, a movable contact, a bistable movable contact support assembly mounted on said body and supporting said movable contact for movement into and out of engagement with said fixed contact with snap action, said contact support assembly providing a first substantially rigid, elongated arm connected at one end to said body by pivot means, a second elongated arm connected at one end to said first arm substantially adjacent to the other end of said first arm, said movable contact being mounted on the other end of said second arm, spring means placing said first arm in axial compression and said second arm in axial tension and operating to produce an unstable condition when the connection between said arms is in a predetermined location, and condition-responsive means operably connected to cause movement of said connection between said arms through said predetermined position and causing said contacts to open and close with snap action, said connection between said arms being structured to prevent bending of said first arm under normal loading thereof whereby said first arm functions as a rigid beam pivoted at one end, said arms being structured so that the planes thereof intersect with a small angle so that relatively small forces applied to said connection between said arms produce substantial shear forces between said contacts to break welds which occur therebetween.

2. A condition sensing switching device as set forth in claim 1, wherein said spring means includes an elongated leg on each of said arms connected together at a leg joint, said leg of said first arm being in tension, and a calibration element engaging said leg of said first arm adjustably positioning said joint, said calibration element being positioned at a location along said leg of said first arm closer to said joint than to the remote end thereof so that said joint remains substantially in a fixed location during operation of said switch.

3. A condition sensing device as set forth in claim 2, wherein associated of said arms and legs are integrally formed from thin metal, and relatively deep flanges are provided on said first arm to cause it to act as a rigid beam pivoted at one end.

4. A condition sensing switching device as set forth in claim 3, wherein said leg of said first arm is provided with stiffening flanges to prevent substantial bending thereof.

5. A condition sensing switching device as set forth in claim 1, wherein said sensing means is thermally responsive and produces closing of said contacts at a first predetermined temperature and opening of said contacts at a second temperature differing from said first temperature by a differential temperature, said spring means including an elongated leg on each of said arms connected together at a leg joint, said leg of said first arm being in tension, and a calibration element engaging said leg of said first arm adjustably positioning said joint, the location of said calibration element along said leg of said first arm in combination with the stiffness of such leg determining said differential temperature.

6. A condition sensing switching device as set forth in claim 1, wherein said connection between said arms is a weld directly connecting said arms in face-to-face adjacency.

7. A condition sensing switching device as set forth in claim 6, wherein said second arm provides pivot means substantially adjacent to the connection between said arms.

8. A thermostat comprising a switch, and a thermal actuator connected to operate said switch in response to changes in temperature, said switch including a fixed contact and a movable contact, a first arm pivotally supported at one end, a second arm, a mounting securing said second arm to the other end of said first arm in face-to-face contact, said movable contact being supported on said second arm at a location spaced from said mounting, and bistable spring means operating to place one of said arms in compression and the other of said arms in tension and causing said contacts to open and close with snap action, said first arm and said second arm each lying along a plane, said planes intersecting substantially at said mounting, said thermal actuator being connected to said arms substantially at said mounting whereby said first arm is substantially free of bending moments.

9. A thermostat as set forth in claim 8, wherein the angle between said planes of said arms is small and said thermal actuator applies a force to said arm substantially perpendicular to said planes.

10. A thermostat as set forth in claim 8, wherein said first arm is in compression and said second arm is in tension, said first arm being formed with stiffening means causing said first arm to operate as a rigid beam pivoted at one end.

11. A thermostat as set forth in claim 10, wherein said first arm is formed of relatively thin metal provided with a reduced cross section to provide said pivot support.

12. A thermostat as set forth in claim 11, wherein said stiffening means are relatively deep axially extending flanges which prevent any material bending of said first arm under normal loading.

13. A thermostat as set forth in claim 12, wherein said second arm is pivotally supported on said first arm substantially adjacent to said mounting.

14. A thermostat as set forth in claim 13, wherein said spring means includes a calibration element which adjustably calibrates the operating temperature of said thermostat.

15. A method of producing a thermostat with a desired operating temperature differential comprising producing a switch having a rigid first arm pivoted at one end and a second arm pivotally connected to said first arm at the other end thereof, providing said arms with associated integral legs connected together at a leg joint, placing said first arm in compression and said second arm along with said leg of said first arm in tension, providing thermal sensing means to move the connected ends of said arms in response to temperature changes, and providing a calibration element operable to adjustably position said joint, and establishing the position of said calibration element along the length of said leg of said first arm in relation to the stiffness of such leg to provide the desired temperature differential.

16. A method of producing a thermostat as set forth in claim 15, including providing said switch with a fixed contact and a movable contact mounted on the free end of said second arm, and limiting the movement of said movable contact in a direction away from said fixed contact to a predetermined distance.

* * * * *